US010071568B2

(12) United States Patent
Miyashita et al.

(10) Patent No.: US 10,071,568 B2
(45) Date of Patent: Sep. 11, 2018

(54) INKJET PRINTER

(71) Applicant: MIMAKI ENGINEERING CO., LTD., Nagano (JP)

(72) Inventors: Eiji Miyashita, Nagano (JP); Katsutoshi Yamabe, Nagano (JP); Hisayuki Kobayashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/310,439

(22) PCT Filed: May 13, 2015

(86) PCT No.: PCT/JP2015/063717
§ 371 (c)(1),
(2) Date: Nov. 10, 2016

(87) PCT Pub. No.: WO2015/174440
PCT Pub. Date: Nov. 19, 2015

(65) Prior Publication Data

US 2017/0072708 A1 Mar. 16, 2017

(30) Foreign Application Priority Data

May 14, 2014 (JP) ..... 2014-100944

(51) Int. Cl.
*B41J 29/38* (2006.01)
*B41J 11/00* (2006.01)
(Continued)

(52) U.S. Cl.
CPC ..... *B41J 11/002* (2013.01); *B41J 2/01* (2013.01); *B41J 11/06* (2013.01); *B41J 29/377* (2013.01); *B41M 5/0017* (2013.01)

(58) Field of Classification Search
USPC ..... 347/16, 102, 108
See application file for complete search history.

(56) References Cited

U.S. PATENT DOCUMENTS 6,340,225 B1 1/2002 Szlucha
7,959,247 B2 * 6/2011 Suzuki ..... B41J 11/06 347/16
(Continued)

FOREIGN PATENT DOCUMENTS

EP 1044817 10/2000
JP 11-179889 7/1999
(Continued)

OTHER PUBLICATIONS

"International Search Report (Form PCT/ISA/210)", dated Jul. 21, 2015, with English translation thereof, pp. 1-4.
(Continued)

*Primary Examiner* — Lam Nguyen
(74) *Attorney, Agent, or Firm* — JCIPRNET

(57) ABSTRACT

An inkjet printer includes an inkjet head configured to perform printing using ink along a main scanning direction onto a print medium by moving in the main scanning direction; a platen configured to support, from an opposite side of the inkjet head, a portion of the print medium being printed by the inkjet head by a printing portion supporting region extending in the main scanning direction; a print heater configured to heat the print medium via the printing portion supporting region; and a fan device extending in the main scanning direction, and configured to blow air out from a blower outlet for blowing the air toward a surface of the portion of the print medium supported by the printing portion supporting region.

4 Claims, 10 Drawing Sheets

(51) Int. Cl.

| | |
|---|---|
| ***B41J 2/01*** | (2006.01) |
| ***B41J 29/377*** | (2006.01) |
| ***B41M 5/00*** | (2006.01) |
| ***B41J 11/06*** | (2006.01) |

(56) References Cited

U.S. PATENT DOCUMENTS

| | | | | |
|---|---|---|---|---|
| 8,820,913 | B2 * | 9/2014 | Koase | B41J 11/002 347/102 |
| 2011/0037819 | A1 * | 2/2011 | Mizutani | B41J 11/002 347/108 |
| 2013/0328963 | A1 | 12/2013 | Domae | |
| 2014/0111586 | A1 | 4/2014 | Kumai | |
| 2015/0321494 | A1 | 11/2015 | Suzuki | |

FOREIGN PATENT DOCUMENTS

| | | |
|---|---|---|
| JP | 2003-326682 | 11/2003 |
| JP | 2010-149319 | 7/2010 |
| JP | 2013-166271 | 8/2013 |

OTHER PUBLICATIONS

"Patent Cooreration Treaty PCT Third Party Observation (PCT Administrative Instructions Part 8)", PCT/JP2015/063717, date of submission:Jul. 19, 2016, pp. 1-4, US20130328963, EP1044817, US20150321494, and US20140111586 were listed.

"Office Action of Japan Counterpart Application," with English translation thereof, dated Feb. 15, 2018, p. 1-p. 7.

* cited by examiner

INKJET PRINTER

CROSS-REFERENCE TO RELATED APPLICATION

This application is a 371 application of an International PCT application Ser. No. PCT/JP2015/063717, filed on May 13, 2015, which claims the priority benefits of Japan Application No. JP 2014-100944, filed on May 14, 2014. The entirety of each of the above-mentioned patent applications is hereby incorporated by reference herein and made a part of this specification.

TECHNICAL FIELD

The present invention relates to an inkjet printer that performs printing on a print medium.

BACKGROUND ART

Conventionally, an inkjet printer is known that is provided with an inkjet head that performs printing using ink along a main scanning direction on a print medium by moving in the main scanning direction, a platen which is provided with a printing portion supporting region extending in the main scanning direction and which is configured to be capable of supporting a portion of the print medium being printed by the inkjet head from an opposite side of the inkjet head, and a heater that extends in the main scanning direction and heats the printing portion supporting region of the platen (for example, see Patent Literature 1).

CITATION LIST

Patent Literature

Patent Literature 1: JP 2010-149319 A

SUMMARY

Technical Problems

In a case where a printing portion supporting region is heated by a heater, an ink droplet discharged from an inkjet head adheres to a print medium heated by the printing portion supporting region, immediately after which an adhered portion on the print medium starts to dry due to the heat of the print medium. That is, a degree of spread of the ink discharged from the inkjet head and adhered to the print medium is determined by a temperature of the print medium heated by the printing portion supporting region. Due to this, a temperature of the printing portion supporting region of the platen greatly affects the degree of spread of the ink discharged from the inkjet head and adhered to the print medium. That is, the temperature of the printing portion supporting region of the platen greatly affects print quality. Especially in a case where ink discharged from the inkjet head is solvent ink in which pigments are diffused in a volatile solvent and which solidifies on the print medium by the solvent evaporation, the temperature of the printing portion supporting region of the platen significantly affects the print quality.

Here, in the conventional inkjet printer, end portions of the printing portion supporting region heated by the heater in the main scanning direction are in contact with a space not heated by the heater, or with a member not heated by the heater along the main scanning direction. Due to this, in the printing portion supporting region heated by the heater, the temperature in the vicinities of the ends in the main scanning direction becomes lower than its temperature in a vicinity of its center. That is, the temperature is non-uniform along the main scanning direction in the printing portion supporting region heated by the heater. Thus, in the conventional inkjet printer, there is a problem that the print quality on the print medium supported by the platen is non-uniform in the main scanning direction.

Thus, the present invention aims to provide an inkjet printer that can improve the quality of the printing as compared to the conventional technique.

Solutions to Problems

An inkjet printer of the present invention includes: an inkjet head configured to perform printing using ink along a particular direction onto a print medium by moving in the particular direction; a platen configured to support, from an opposite side of the inkjet head, a portion of the print medium being printed by the inkjet head by a printing portion supporting region extending in the particular direction; a heater section configured to heat the print medium via the printing portion supporting region; and an air blowing section extending in the particular direction, and configured to blow air out from a blower outlet for blowing the air toward a surface of the portion of the print medium supported by the printing portion supporting region.

According to this configuration, the inkjet printer of the present invention blows air from the blower outlet extending in the particular direction toward the surface of the portion of the print medium which is supported by the printing portion supporting region extending in the particular direction and which is heated by the heater section. Thus, a high-temperature portion in the particular direction within the portion of the print medium supported by the printing portion supporting region can efficiently be cooled, and the temperature of the portion of the print medium supported by the printing portion supporting region along the particular direction can be made more uniform than in the conventional configuration. Thus, the inkjet printer of the present invention can make print quality on the print medium supported by the platen to become more uniform in the particular direction than in the conventional configuration. That is, the inkjet printer of the present invention can improve quality of printing as compared to conventional techniques.

Further, in the inkjet printer of the present invention, the blower outlet may be divided into a plurality of partitions along the particular direction.

According to this configuration, as the inkjet printer of the present invention divides the air blown out from the blower outlet along the particular direction according to each of the plurality of partitions of the blower outlet, generation of disturbance in the air blown out from the blower outlet can be suppressed compared to a configuration in which the blower outlet is not divided along the particular direction. That is, as compared to the configuration in which the blower outlet is not divided along the particular direction, the inkjet printer of the present invention can blow the air accurately from the blower outlet extending in the particular direction toward the surface of the portion of the print medium which is supported by the printing portion supporting region extending in the particular direction and which is heated by the heater section. Due to this, the inkjet printer of the present invention can efficiently cool the high-temperature portion in the particular direction within the portion of the print medium supported by the printing portion supporting region. Accordingly, the inkjet printer of the present invention can improve the quality of the printing.

Further, the inkjet printer of the present invention may further include a transporter configured to transport the print medium in a direction intersecting the particular direction, where the air blowing section may be configured so that, of the air blown toward the surface of the portion of the print medium supported by the printing portion supporting region, an amount flowing to an upstream side than the printing portion supporting region along a transport direction of the print medium by the transporter is smaller than an amount flowing to a downstream side than the printing portion supporting region in the transport direction.

According to this configuration, even in a case where ink mist smaller than the ink droplets is generated when the ink droplets are discharged from the inkjet head, the inkjet printer of the present invention can suppress the ink from adhering onto the print medium on the upstream side than the printing portion supporting region along the transport direction of the print medium, that is, on the print medium to which the printing by the inkjet head has not yet been performed, because the ink mist will be flown toward the downstream side than the printing portion supporting region along the transport direction of the print medium by the air blown out from the blower outlet. Accordingly, the inkjet printer of the present invention can improve the quality of the printing.

Further, in the inkjet printer of the present invention, the air blowing section may include an air blower configured to generate the air blown out from the plurality of partitions, the air blowing section may include a plurality of passages for the air generated by the air blower to pass through, and the plurality of passages may respectively be communicated with different ones of the partitions.

According to this configuration, when the air to be blown out from the plurality of partitions of the blower outlet is generated by the fan device, the inkjet printer of the present invention can suppress the generation of disturbance in the air from the time when the air is generated by the fan device to the time when it is blown out from the partitions of the blower outlet by the presence of the passages, since the plurality of passages each communicate with different partitions of the blower outlet. That is, the inkjet printer of the present invention can blow the air accurately from the blower outlet extending in the particular direction toward the surface of the portion of the print medium which is supported by the printing portion supporting region extending in the particular direction and which is heated by the heater section. Due to this, the inkjet printer of the present invention can efficiently cool the high-temperature portion in the particular direction within the portion of the print medium supported by the printing portion supporting region. Accordingly, the inkjet printer of the present invention can improve the quality of the printing.

Further, in the inkjet printer of the present invention, the air blowing section may include a plurality of units, in each of which one or more of the partitions are formed.

According to this configuration, as the inkjet printer of the present invention can use a mutual unit specification among other inkjet printers having different widths of blower outlet in the particular direction, a manufacturing cost of the units can be reduced by mass production of the units.

Effect of the Invention

The inkjet printer of the present invention can improve the quality of the printing as compared to the conventional technique.

EMBODIMENTS OF THE INVENTION

Hereinbelow, embodiments of the present invention will be described with reference to the drawings.

Firstly, a configuration of an inkjet printer according to the present embodiment will be described.

Figure 1:
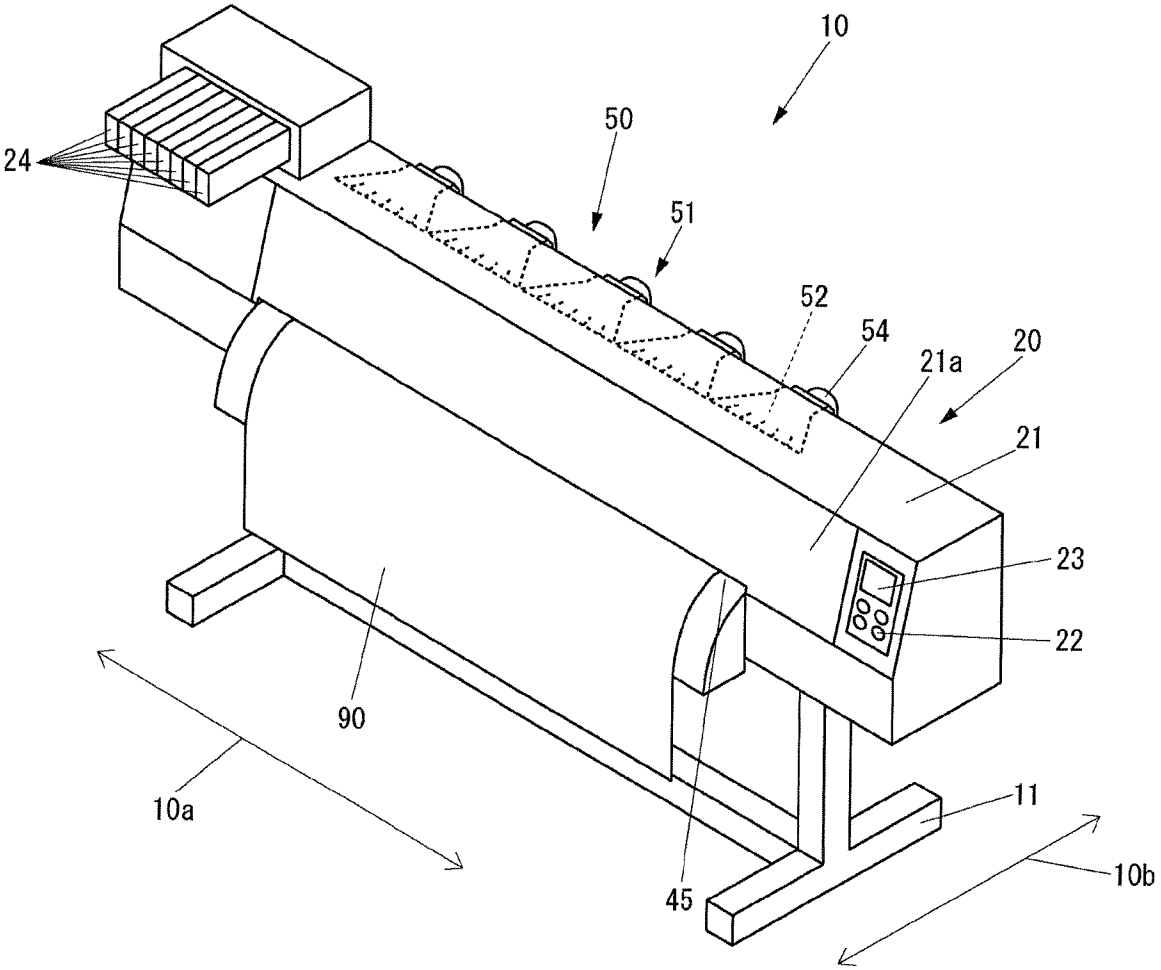
FIG. 1 is an outer perspective diagram of an inkjet printer of an embodiment of the present invention as seen from a front right upper side.

FIG. 1 is an outer perspective diagram of an inkjet printer 10 of the present embodiment as seen from a front right upper side.

As illustrated in FIG. 1, the inkjet printer 10 includes a leg 11 installed on a floor, and a main body 20 supported by the leg 11.

The main body 20 includes a case 21 that covers an inside of the main body 20, an operation device 22 being an input device such as buttons for inputting various operations, a display 23 being a display device such as an LCD (Liquid Crystal Display) for displaying various types of information, and a plurality of ink tanks 24 for storing ink.

The case 21 includes a detachable front cover 21*a*.

Figure 2:
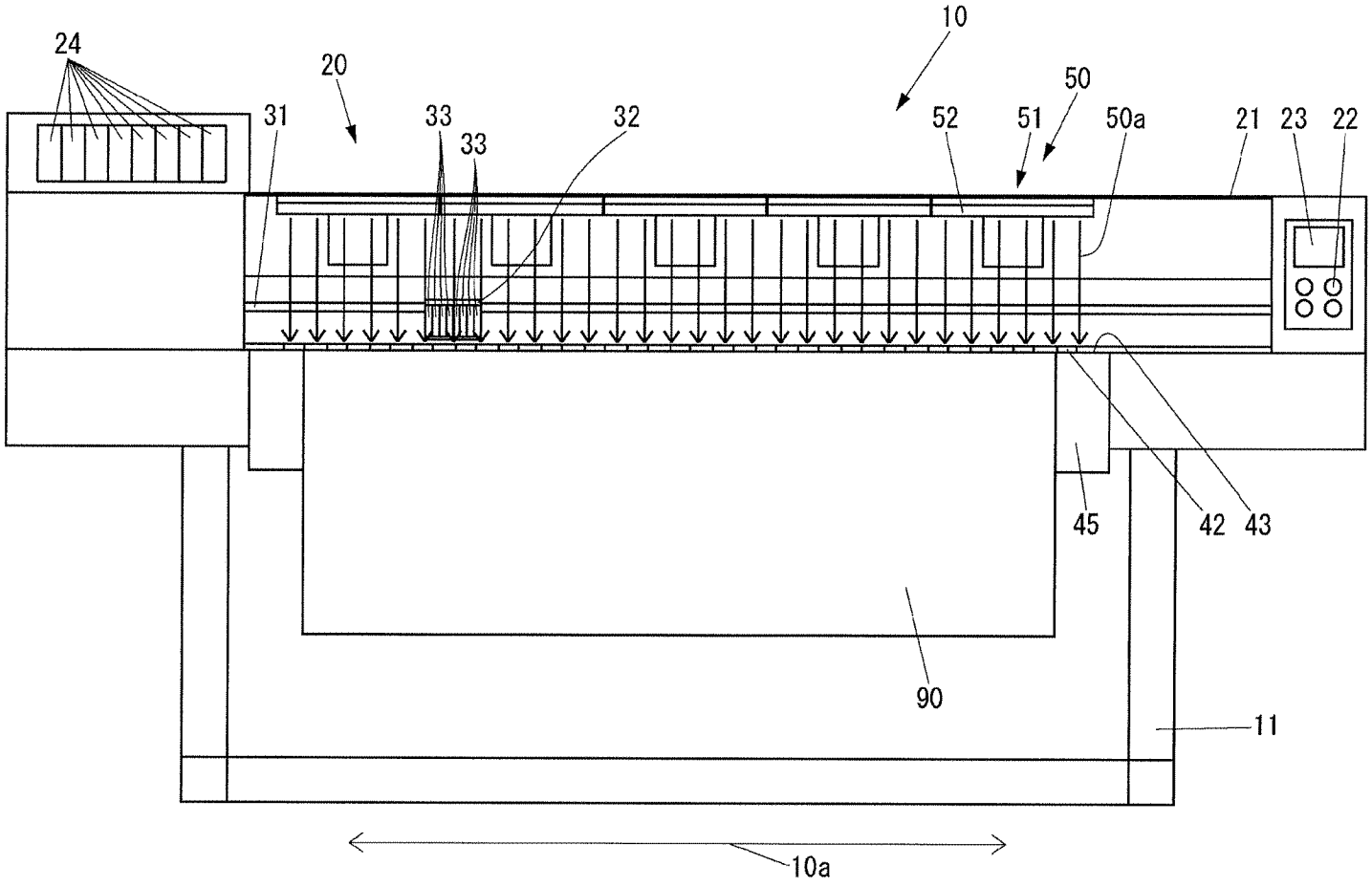
FIG. 2 is a front view of the inkjet printer illustrated in FIG. 1 in a state where a front cover is taken off.

FIG. 2 is a front view of the inkjet printer 10 in a state where the front cover 21*a* is taken off.

As illustrated in FIG. 2, the main body 20 includes a guide rail 31 extending along a main scanning direction indicated by an arrow 10*a*, a carriage 32 supported on the guide rail 31 so as to be movable in the main scanning direction, and a plurality of inkjet heads 33 installed on the carriage 32 for discharging the ink toward the print medium 90.

The inkjet head 33 can move in a particular direction, that is, in the main scanning direction by being mounted on the carriage 32 capable of moving along the guide rail 31 along the main scanning direction indicated by the arrow 10*a*. The inkjet head 33 can perform printing using ink along the main scanning direction relative to the print medium 90 by moving in the main scanning direction.

Figure 3:
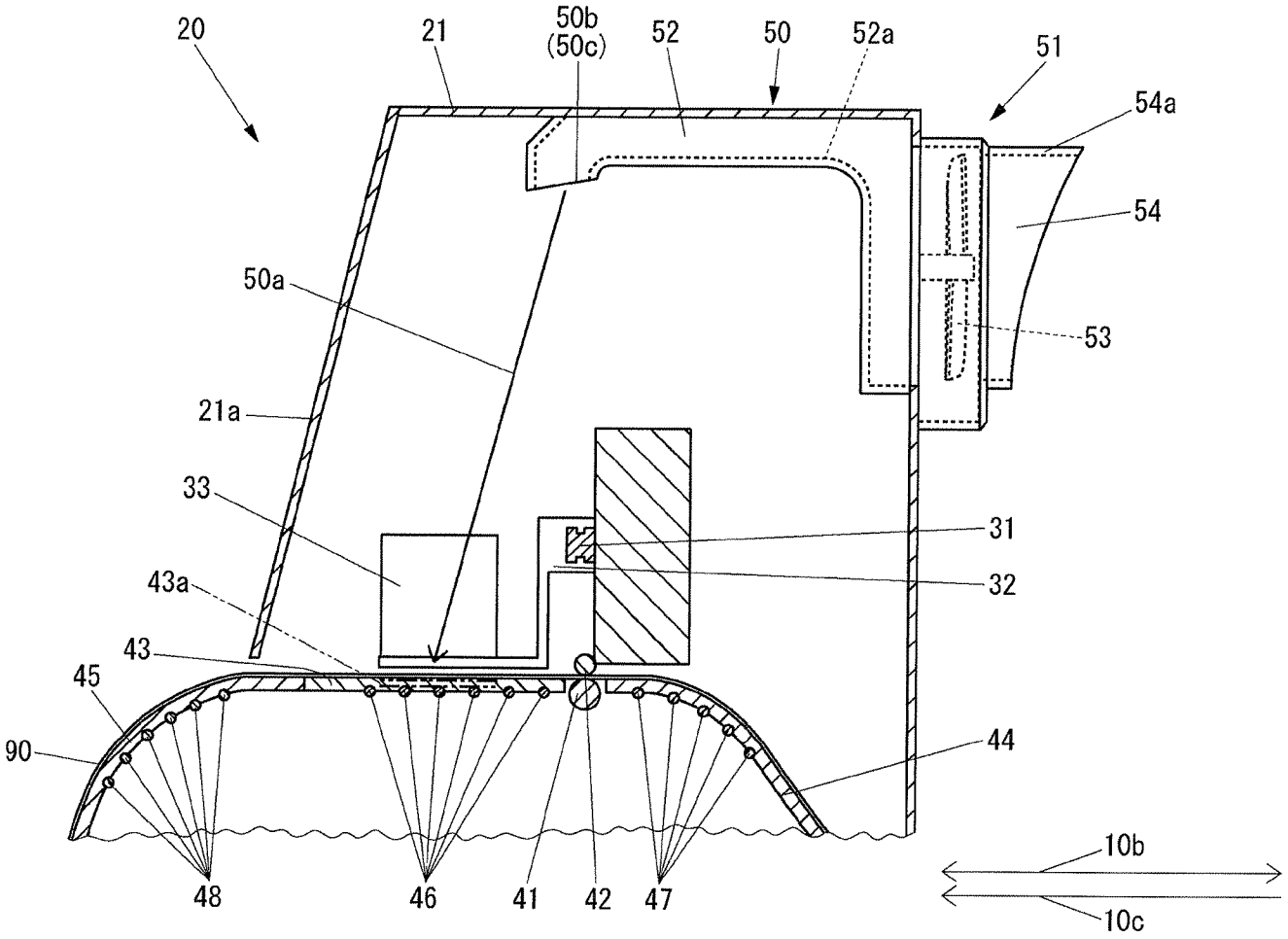
FIG. 3 is a side surface cross sectional diagram of a part of a main body illustrated in FIG. 1.

FIG. 3 is a side surface cross sectional diagram of a part of the main body 20.

As illustrated in FIGS. 2 and 3, the main body 20 includes a transport roller 41 as a transporter that transports the print medium 90 in a direction shown by an arrow 10*c* within the sub scanning direction shown by the arrow 10*b* that vertically intersects with the main scanning direction indicated by the arrow 10*a*, a pinch roller 42 for pinching the print medium 90 together with the transport roller 41, a platen 43 that supports the print medium 90, a pre-print platen 44 arranged on an upstream side of the platen 43 in the transport direction of the print medium 90 by the transport roller 41, that is, in the transport direction shown by the arrow 10*c* for supporting the print medium 90, a post-print platen 45 arranged on a downstream side of the platen 43 in the transport direction shown by the arrow 10*c* for supporting the print medium 90, a print heater 46 as a heater section for heating the platen 43, a pre-print heater 47 for heating the pre-print platen 44, and a post-print heater 48 for heating the post-print platen 45.

The transport roller 41 and the pinch roller 42 extend along the main scanning direction indicated by the arrow 10*a*, and are supported rotatably with their rotation axis being in the main scanning direction.

The platen 43, the pre-print platen 44, and the post-print platen 45 extend in the main scanning direction indicated by the arrow 10*a*.

The platen 43 is arranged opposite to the inkjet head 33 with the transport passage of the print medium 90 interposed in between. The platen 43 supports the recording medium 90 that is in printing from a surface opposing the inkjet head 33. A region in the platen 43 that supports a portion of the print medium 90 being printed is hereinbelow termed a printing portion supporting region 43*a*. The printing portion supporting region 43*a* extends along the main scanning direction indicated by the arrow 10*a*. The print medium 90 is heated by the print heater 46 via the printing portion supporting region 43*a*.

The print heater 46, the pre-print heater 47, and the post-print heater 48 are configured of heater lines extending in the main scanning direction indicated by the arrow 10*a*. Especially, the print heater 46 can heat the printing portion supporting region 43*a* of the platen 43.

Figure 4:
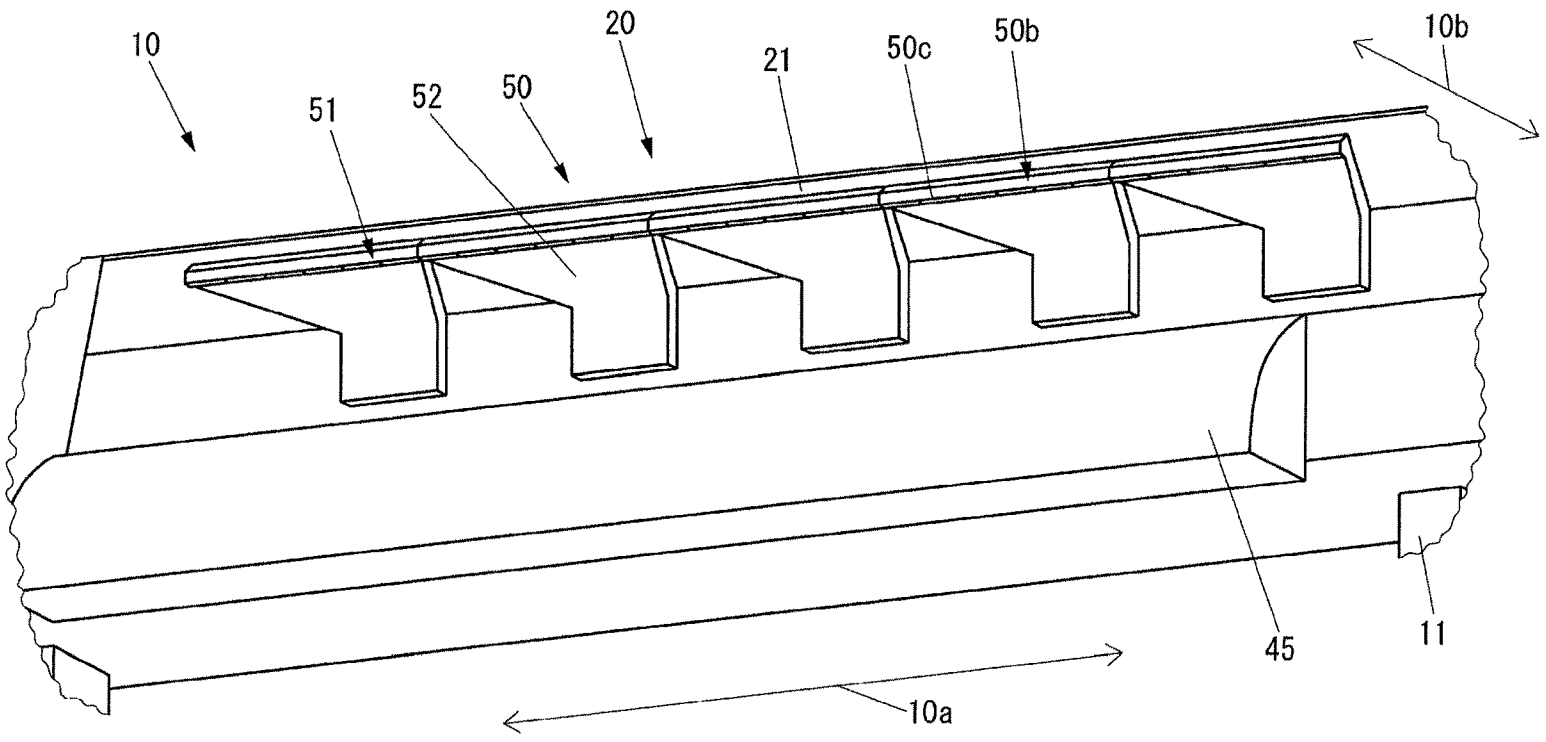
FIG. 4 is a perspective diagram of a part of the inkjet printer illustrated in FIG. 1 as seen from a front right lower side in the state where the front cover is taken off.
Figure 5:
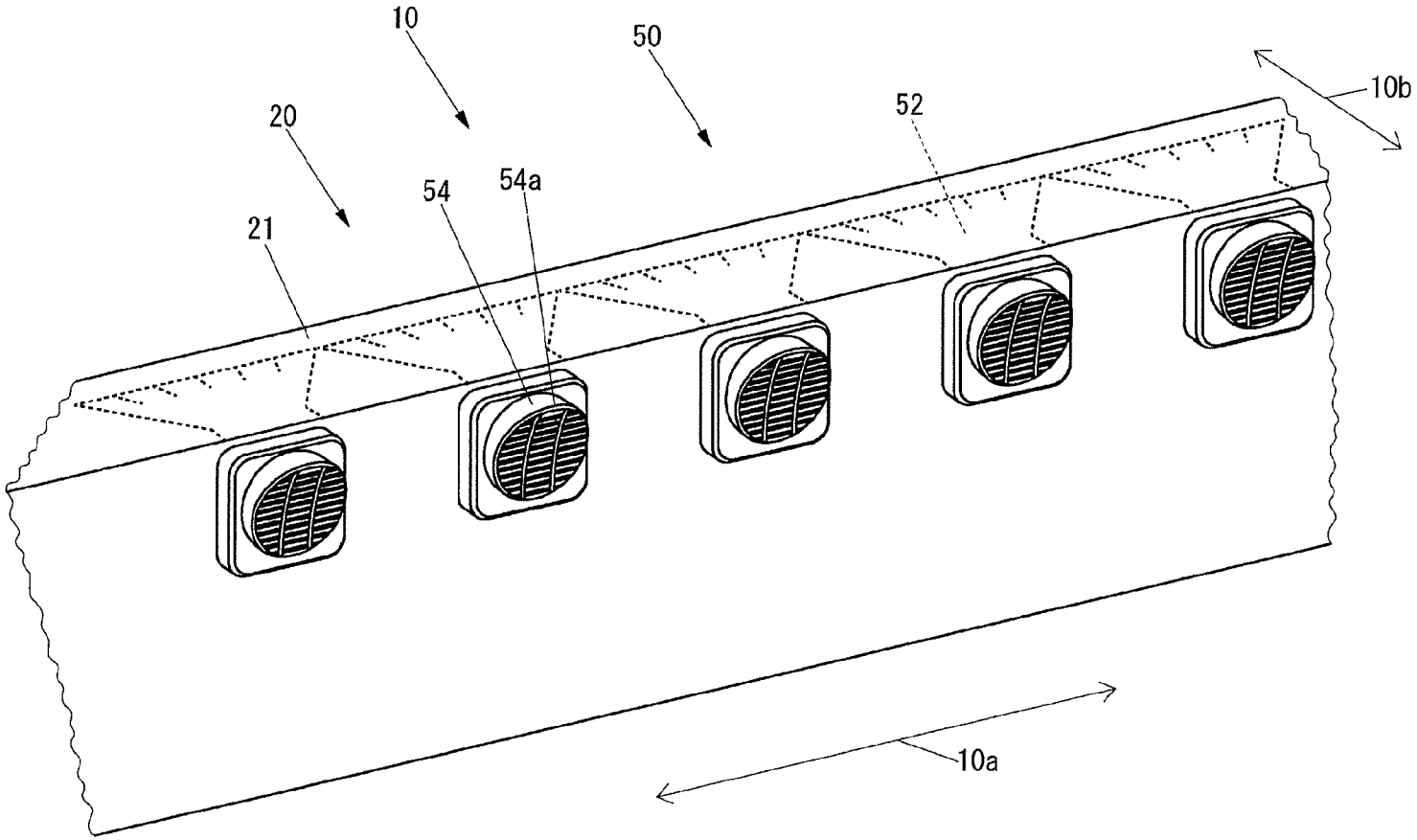
FIG. 5 is a perspective diagram of a part of the inkjet printer illustrated in FIG. 1 as seen from a rear upper side.

FIG. 4 is a perspective diagram of a part of the inkjet printer 10 as seen from a front right lower side in the state where the front cover 21 a is taken off. FIG. 5 is a perspective diagram of a part of the inkjet printer 10 as seen from a rear upper side.

As illustrated in FIGS. 1 to 5, the main body 20 includes a fan device 50 as an air blowing section for blowing air 50*a* toward a surface of the printing portion supporting region 43*a* of the platen 43.

The fan device 50 has a blower outlet 50*b* for blowing the air 50*a* out. That is, the fan device 50 is configured to blow the air 50*a* from the blower outlet 50*b* toward the surface of the printing portion supporting region 43*a* of the platen 43.

Figure 6:
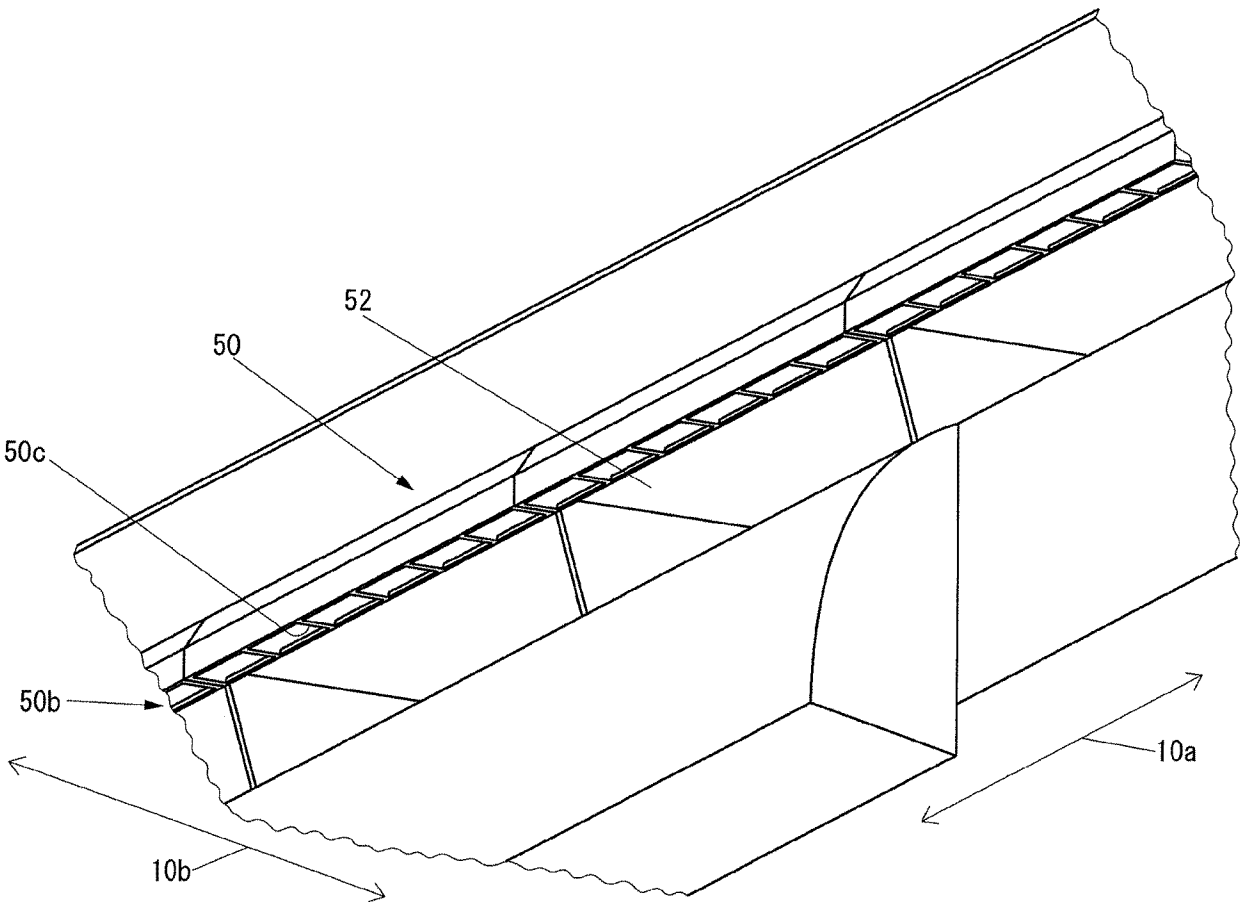
FIG. 6 is a perspective diagram of a part of a fan device illustrated in FIG. 1 as seen from the front right lower side in the state where the front cover is taken off.

FIG. 6 is a perspective diagram of a part of the fan device 50 as seen from the front right lower side in the state where the front cover 21*a* is taken off.

As illustrated in FIGS. 4 and 6, the blower outlet 50*b* extends in the main scanning direction indicated by the arrow 10*a*. Further, the blower outlet 50*b* is divided into thirty partitions 50*c* along the main scanning direction.

As illustrated in FIGS. 1, 2, and 4, the fan device 50 includes five units 51 in each of which six partitions 50*c* of the blower outlet 50*b* are provided.

Figure 7:
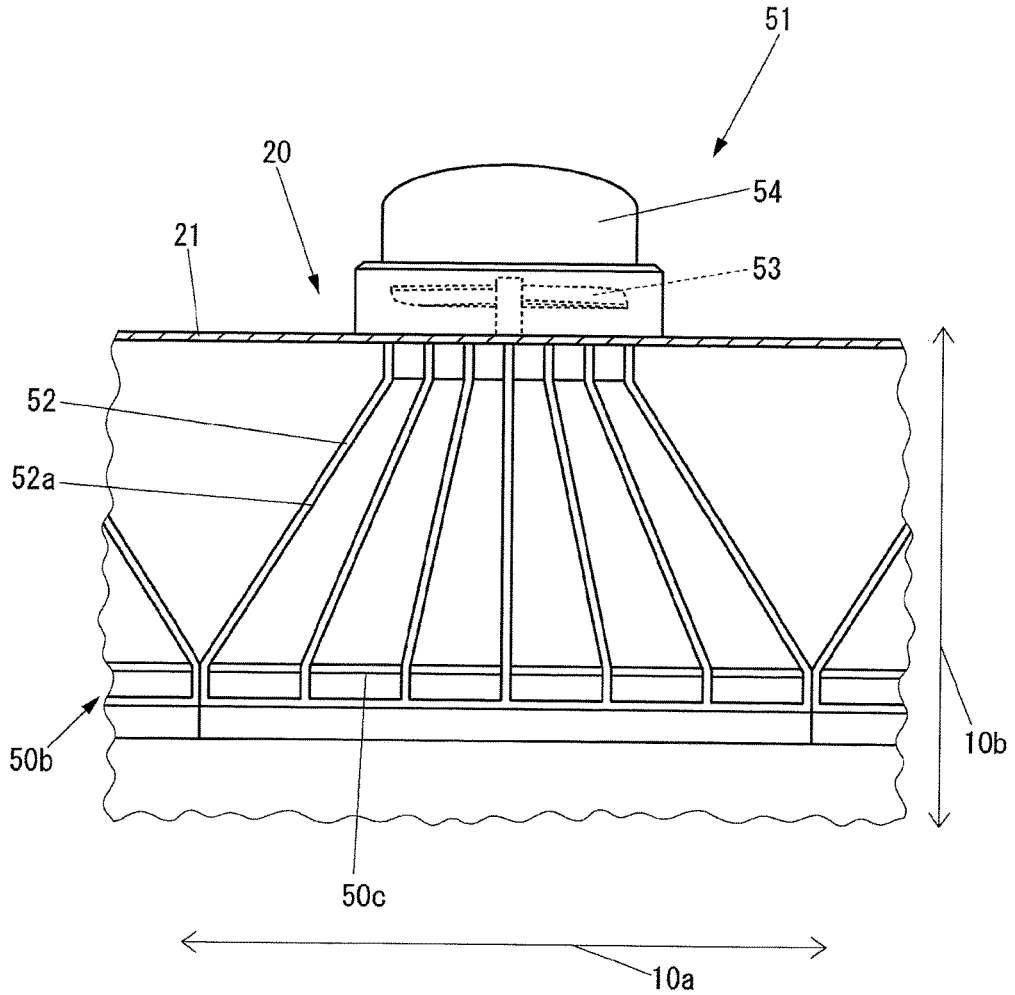
FIG. 7 is an upper surface cross sectional diagram of a part of the main body illustrated in FIG. 1.
Figure 8:
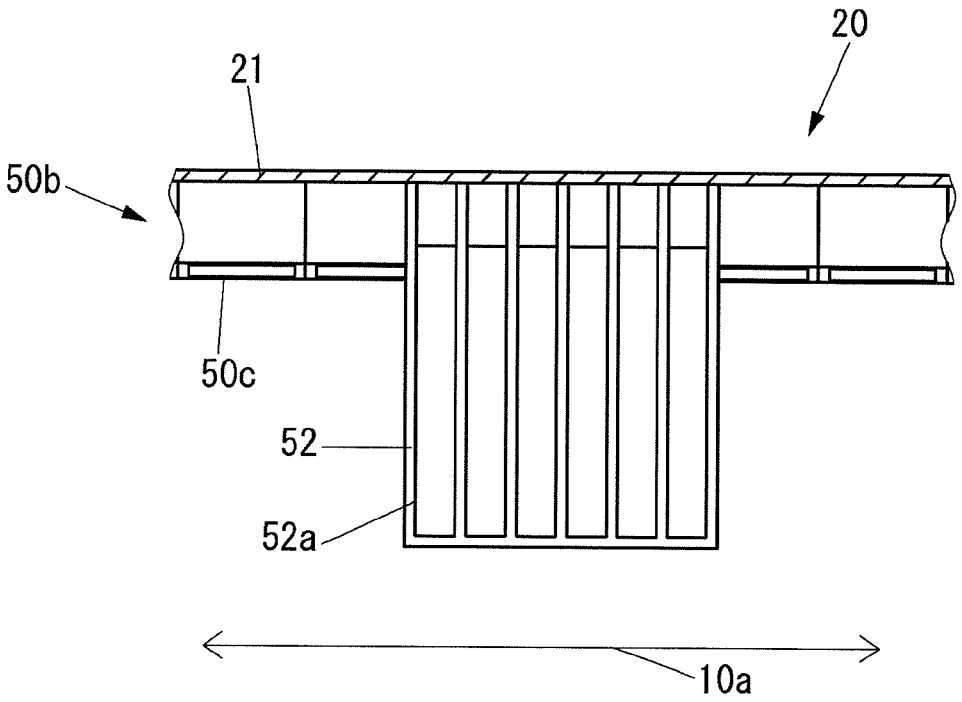
FIG. 8 is a rear surface cross sectional diagram of a part of the main body illustrated in FIG. 1.

FIG. 7 is an upper surface cross sectional diagram of a part of the main body 20. FIG. 8 is a rear surface cross sectional diagram of a part of the main body 20.

As illustrated in FIGS. 3, 7, and 8, each of the five units 51 includes a passage forming member 52 in which six passages 52*a* for the air 50*a* to pass through, a fan 53 as an air blower for sending the air 50*a* into the six passages 52*a* of the passage forming member 52, and a fan cover 54 for covering the fan 53.

The passage forming member 52 has the six partitions 50*c* of the blower outlet 50*b*. The six passages 52*a* of the passage forming member 52 communicate respectively with different partitions 50*c*.

Figure 9:
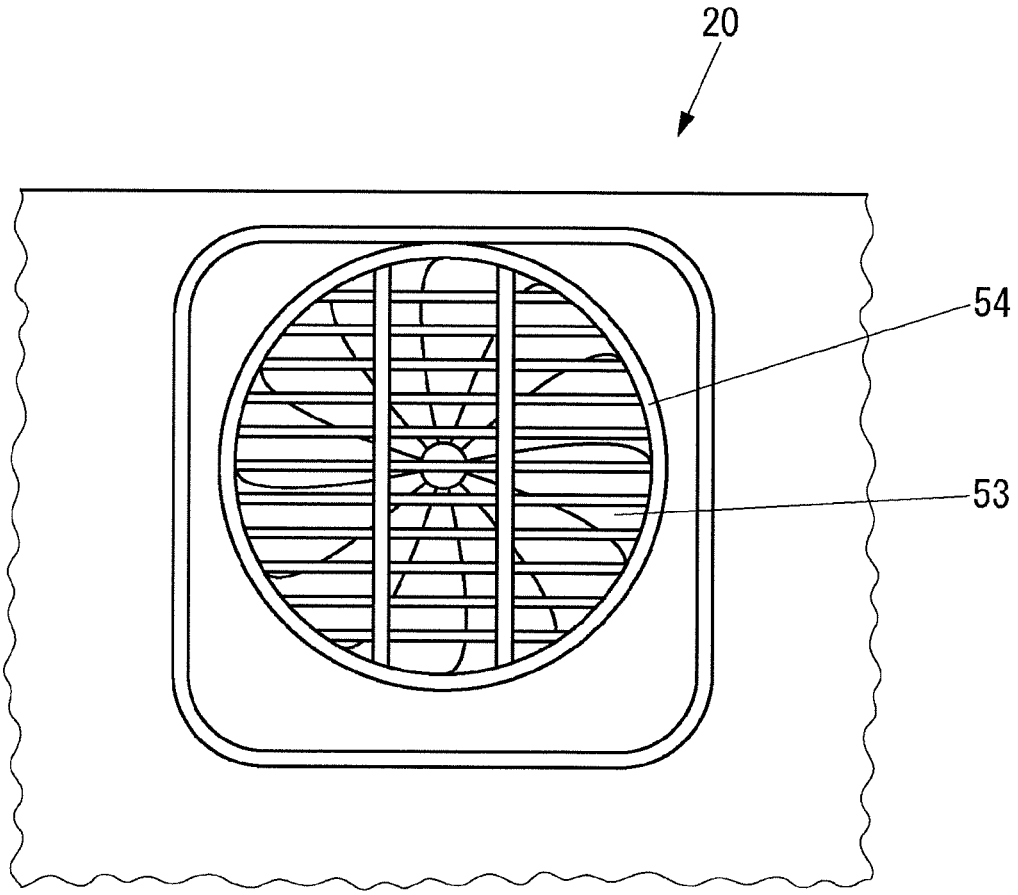
FIG. 9 is a rear surface diagram of a part of the main body illustrated in FIG. 1.

FIG. 9 is a rear surface diagram of a part of the main body 20.

As illustrated in FIGS. 7 to 9, the fan 53 is configured to send the air 50*a* into the six passages 52*a* of the passage forming member 52.

As illustrated in FIGS. 3 and 5, the fan cover 54 includes a hood 54*a* for suppressing floating matters such as dusts from being sucked into the main body 20 by the fan 53.

As illustrated in FIG. 3, shapes of the partitions 50*c* in the blower outlet 50*b* of each unit 51 and the passages 52*a* are configured so that, of the air 50*a* blown toward the surface of the printing portion supporting region 43*a* of the platen 43, an amount flowing to an upstream side than the printing portion supporting region 43*a* along the transport direction shown by the arrow 10*c* is smaller than an amount flowing to a downstream side than the printing portion supporting region 43*a* in the transport direction.

Figure 10:
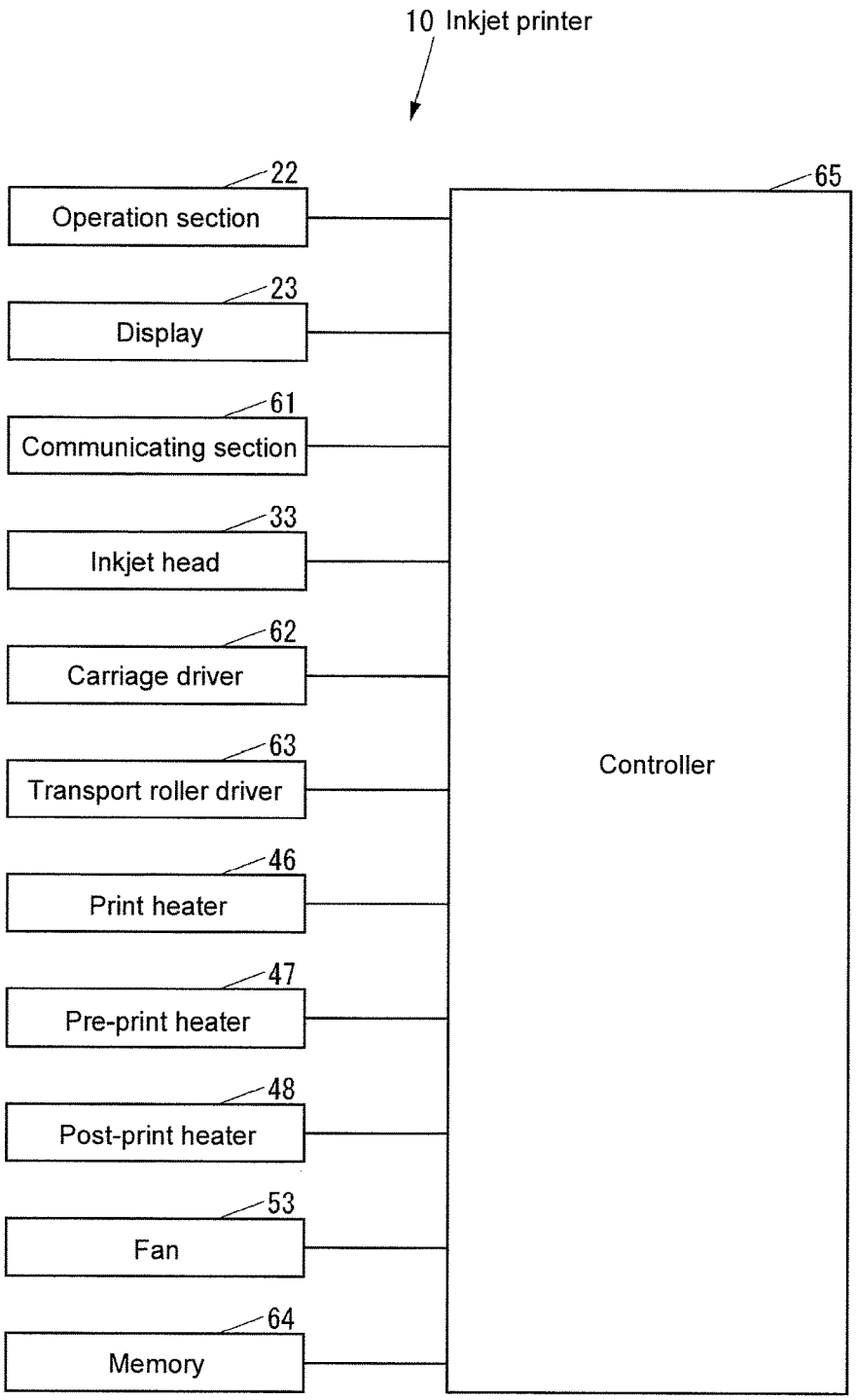
FIG. 10 is a block diagram of the inkjet printer illustrated in FIG. 1.

FIG. 10 is a block diagram of the inkjet printer 10.

As illustrated in FIG. 10, the inkjet printer 10 includes the aforementioned operation section 22 and the display 23, a communicating section 61 being a communication device for communicating with an external device such as a PC (Personal Computer), the aforementioned inkjet head 33, a carriage driver 62 for moving the carriage 32 (see FIG. 2) in the main scanning direction shown by the arrow 10*a* (see FIG. 2) along the guide rail 31 (see FIG. 2), a transport roller driver 63 for rotating the transport roller 41 (see FIG. 3), the aforementioned print heater 46, pre-print heater 47, post-print heater 48, and fan 53, a memory 64 being a memory device such as an EEPROM (Electrically Erasable Programmable Read Only Memory) for storing various types of data, and a controller 65 for controlling an entirety of the inkjet printer 10.

The controller 65 includes, for example, a CPU (Central Processing Unit), a ROM (Read Only Memory) that stores programs and various types of data in advance, and a RAM (Random Access Memory) to be used as a work area for the CPU. The CPU is configured to execute the programs stored in the ROM or the memory 64.

Next, an operation of the inkjet printer 10 will be described.

When print data sent from outside is received through the communication section 61, the controller 65 of the inkjet printer 10 controls the inkjet head 33, the carriage driver 62, and the transport roller driver 63 based on this print data to perform printing by the inkjet head 33.

Specifically, the controller 65 controls the carriage driver 62 to move the carriage 32 along the guide rail 31 in the main scanning direction indicated by the arrow 10*a*. The carriage 32 is installed with the inkjet head 33. Thus, the inkjet head 33 moves relatively in the main scanning direction with respect to the print medium 90. At this occasion, the controller 65 executes the printing in the main scanning direction by discharging the ink droplets by the inkjet head 33 toward the print medium 90. Then, each time the printing in the main scanning direction is completed, the controller 65 controls the transport roller driver 63 to rotate the transport roller 41 so that the print medium 90 pinched between the transport roller 41 and the pinch roller 42 is moved in the direction shown by the arrow 10*c*. That is, the controller 65 changes a printing position on the print medium 90 along the direction shown by the arrow 10*c* by the inkjet head 33 by moving the print medium 90 in the direction shown by the arrow 10*c* relative to the inkjet head 33. Then, at the new printing position in the direction shown by the arrow 10*c*, the controller 65 again performs the printing in the main scanning direction.

When performing the printing by the inkjet head 33, the controller 65 drives the print heater 46, the pre-print heater 47, and the post-print heater 48. The print heater 46, the pre-print heater 47, and the post-print heater 48 respectively heat the platen 43, the pre-print platen 44, and the post-print platen 45.

Further, when causing the print heater 46 to heat the platen 43, the controller 65 drives the fans 53 to blow the air 50*a* toward the surface of the printing portion supporting region 43*a* of the platen 43 from the blower outlet 50*b* of the fan device 50. That is, the controller 65 blows the air 50*a* from the blower outlet 50*b* toward a surface of a portion of the print medium 90 that is being heated by the print heater 46 via the printing portion supporting region 43*a*.

As described above, the inkjet printer 10 blows the air 50*a* from the blower outlet 50*b* extending in the main scanning direction toward the surface of the portion of the print medium 90 that is heated by the print heater 46 via the printing portion supporting region 43*a* extending in the main scanning direction indicated by the arrow 10*a*. Thus, the inkjet printer 10 can efficiently cool the high-temperature portion of the print medium 90 within the portion thereof supported by the printing portion supporting region 43*a* in the main scanning direction. Thus, a temperature of the portion of the print medium 90 supported by the printing portion supporting region 43*a* in the main scanning direction can be made more uniform than in conventional configurations.

Thus, the inkjet printer 10 can make the quality of printing on the print medium 90 supported by the platen 43 more uniform in the main scanning direction than in the conventional configurations.

That is, the inkjet printer 10 can improve the quality of printing as compared to the conventional techniques.

The inkjet printer 10 has the air 50*a* blown out from the blower outlet 50*b* divided according to the plurality of partitions 50*c* of the blower outlet 50*b* in the main scanning direction indicated by the arrow 10*a*. Thus, as compared to a configuration in which the blower outlet 50*b* is not divided in the main scanning direction, the air 50*a* blown out from the blower outlet 50*b* can be suppressed from generating turbulence. That is, as compared to the configuration in which the blower outlet 50*b* is not divided in the main scanning direction, the inkjet printer 10 can more accurately blow the air 50*a* from the blower outlet 50*b* extending in the main scanning direction toward the surface of the portion of the print medium 90 heated by the print heater 46 via the printing portion supporting region 43*a*. Thus, the inkjet printer 10 can efficiently cool the high-temperature portion of the print medium 90 within the portion thereof supported by the printing portion supporting region 43*a* in the main scanning direction. Accordingly, the inkjet printer 10 can improve the quality of the printing.

It should be noted that the blower outlet 50*b* of the inkjet printer 10 does not have to be divided in the main scanning direction indicated by the arrow 10*a*.

The fan device 50 is configured so that, of the air 50*a* blown toward the surface of the portion of the print medium 90 supported by the printing portion supporting region 43*a*, the amount flowing to the upstream side than the printing portion supporting region 43*a* along the transport direction of the print medium 90 by the transport roller 41 shown by the arrow 10*c* is smaller than the amount flowing to the downstream side than the printing portion supporting region 43*a* in the transport direction. Specifically, the blower outlet 50*b* includes fins for blowing the air 50*a* out toward the print medium 90 with an oblique angle toward the downstream side of the print medium transport direction relative to a vertical direction. The fins extend in the main scanning direction and are arranged obliquely with an angle relative to the vertical direction. Due to this, even if ink mist that is smaller than the ink droplets is generated when the ink droplets are discharged from the inkjet head 33, the inkjet printer 10 can flow the ink mist to the downstream side than the printing portion supporting region 43*a* in the transport direction by the air 50*a* blown out from the blower outlet 50*b*. Accordingly, the inkjet printer 10 can suppress the ink from adhering onto the print medium 90 on the upstream side than the printing portion supporting region 43*a* in the transport direction, that is, to the print medium 90 that has not yet been subjected to the printing by the inkjet head 33.

Here, as a pattern by which the ink adheres to the print medium 90 that has not yet been subjected to the printing, for example, there is a pattern in which the mist flown to the upstream side than the printing portion supporting region 43*a* in the transport direction shown by the arrow 10*c* by the air 50*a* blown out from the blower outlet 50*b* adheres directly onto the print medium 90 that has not yet been subjected to the printing. Further, there also is a pattern in which the mist flown to the upstream side than the printing portion supporting region 43*a* in the transport direction by the air 50*a* blown out from the blower outlet 50*b* adheres onto a portion, such as the pinch roller 42, which would make contact with the print medium 90 that has not yet been subjected to the printing, and thereafter ink adheres to the print medium 90 that has not yet been subjected to the printing by the aforementioned portions making contact with the print medium 90 that has not yet been subjected to the printing.

Further, when the ink adheres to the print medium 90 that has not yet been subjected to the printing, the printing by the inkjet head 33 is performed as an overlaying layer of the adhered ink, thus there is a problem that the print quality would be degraded compared to a case where no ink is adhered to the print medium 90 that has not yet been subjected to the printing. Moreover, if the ink adheres to the portions such as the pinch roller 42 that make contact with the print medium 90 that has not yet been subjected to the printing, streaking smear of ink adheres to the print medium 90 that has not yet been subjected to the printing by such portions making contact with the print medium 90 that has not yet been subjected to the printing, thus there also is a problem that the print quality would be degraded thereby.

However, since the inkjet printer 10 can suppress the ink from adhering to the print medium 90 that has not yet been subjected to the printing by the inkjet head 33, as aforementioned, so the print quality can be improved.

Since the plurality of passages 52*a* is respectively communicated with different partitions 50*c* of the blower outlet 50*b*, when the air 50*a* to be blown out from the plurality of partitions 50*c* of the blower outlet 50*b* is generated by the fans 53, the inkjet printer 10 can suppress the generation of disturbance in the air 50*a* from the time when the air 50*a* is generated by the fans 53 to the time when it is blown out from the partitions 50*c* of the blower outlet 50*b* by the presence of the passages 52*a*. That is, the inkjet printer 10 can accurately blow the air 50*a* from the blower outlet 50*b* extending in the main scanning direction indicated by the arrow 10*a* toward the surface of the portion of the print medium 90 which is supported by the printing portion supporting region 43*a* and which is heated by the print heater 46. Thus, the inkjet printer 10 can efficiently cool the high-temperature portion of the print medium 90 within the portion thereof supported by the printing portion supporting region 43*a* in the main scanning direction. Accordingly, the inkjet printer 10 can improve the quality of the printing.

As the inkjet printer 10 can use a mutual specification for the units 51 among other inkjet printers 10 having different widths of blower outlets 50*b* in the main scanning direction indicated by the arrow 10*a*, a manufacturing cost of the units 51 can be reduced by mass production of the units 51.

It should be noted that the inkjet printer 10 of the present embodiment has six partitions 50*c* formed in each unit 51; however, simply one or more partitions 50*c* may be formed in each unit 51. Further, the inkjet printer 10 of the present embodiment has five units 51; however, simply one or more units 51 may be provided.

The inkjet printer 10 in the present embodiment blows the air 50*a* by the fan device 50 toward an entire surface of the printing portion supporting region 43*a* in the main scanning direction indicated by the arrow 10*a*. However, the inkjet printer 10 may be configured not to blow the air 50*a* by the fan device 50 toward the surface in vicinities of ends of the printing portion supporting region 43*a* in the main scanning direction.

In the main scanning direction, a center portion of the printing portion supporting region 43*a* will have a higher temperature than other regions. Thus, a temperature distribution that has been non-uniform can be brought closer to being uniform by blowing the air 50*a* by the fan device 50 toward the printing portion supporting region 43*a*.

The fan device 50 of the inkjet printer 10 is configured to inhale gas, not from an upper side in the vertical direction but from a horizontal direction. In addition, the fan cover 54 includes the hood 54*a*, thus floating matters such as dusts can be suppressed from being inhaled by the fan 53 from outside the main body 20. Accordingly, the inkjet printer 10 can improve the quality of the printing.

It should be noted that the inkjet printer 10 of the present embodiment includes the print heater 46 that heats the printing portion supporting region 43*a* of the platen 43 as the heater section for heating at least the portion of the print medium 90 supported by the printing portion supporting region 43*a*. However, the inkjet printer 10 may be provided with other configurations than the print heater 46, so long as at least the portion of the print medium 90 supported by the printing portion supporting region 43*a* is heated due to the configurations.

The inkjet printer 10 of the present embodiment is configured to move the inkjet head 33 and the print medium 90 in a relative manner in the direction shown by the arrow 10*b* by transporting the print medium 90 in the direction shown by the arrow 10*c*. However, such may be configured otherwise.

For example, the inkjet printer 10 may be configured to move the inkjet head 33 and the print medium 90 in the relative manner in the direction shown by the arrow 10*b* by moving the inkjet head 33 in the direction shown by the arrow 10*c*.

The invention claimed is:

1. An inkjet printer, comprising:

an inkjet head configured to perform printing using ink along a particular direction onto a print medium by moving in the particular direction;

a platen configured to support, from an opposite side of the inkjet head, a portion of the print medium being printed by the inkjet head by a printing portion supporting region extending in the particular direction;

a heater configured to heat the print medium via the printing portion supporting region; and an air blowing section extending in the particular direction, and configured to blow air out from a blower outlet for blowing the air toward a surface of the portion of the print medium supported by the printing portion supporting region, the inkjet printer further comprising:

a transporter configured to transport the print medium in a direction intersecting the particular direction, wherein the air blowing section is configured so that, of the air blown toward the surface of the portion of the print medium supported by the printing portion supporting region, an amount flowing to an upstream side than the printing portion supporting region along a transport direction of the print medium by the transporter is smaller than an amount flowing to a downstream side than the printing portion supporting region in the transport direction.

2. An inkjet printer, comprising:

an inkjet head configured to perform printing using ink along a particular direction onto a print medium by moving in the particular direction;

a platen configured to support, from an opposite side of the inkjet head, a portion of the print medium being printed by the inkjet head by a printing portion supporting region extending in the particular direction;

a heater configured to heat the print medium via the printing portion supporting region; and an air blowing section extending in the particular direction, and configured to blow air out from a blower outlet for blowing the air toward a surface of the portion of the print medium supported by the printing portion supporting region, wherein the blower outlet is divided into a plurality of partitions along the particular direction, wherein the air blowing section includes an air blower configured to generate the air blown out from the plurality of partitions, the air blowing section includes a plurality of passages for the air generated by the air blower to pass through, and the plurality of passages are respectively communicated with different ones of the partitions.

3. The inkjet printer as set forth in claim 2, wherein the air blowing section includes a plurality of units, in each of which one or more of the partitions are formed.

4. An inkjet printer, comprising:

an inkjet head configured to perform printing using ink along a particular direction onto a print medium by moving in the particular direction;

a platen configured to support, from an opposite side of the inkjet head, a portion of the print medium being printed by the inkjet head by a printing portion supporting region extending in the particular direction;

a heater configured to heat the print medium via the printing portion supporting region; and an air blowing section extending in the particular direction, and configured to blow air out from a blower outlet for blowing the air toward a surface in a vicinity of a center in the particular direction of the print medium supported by the printing portion supporting region, so as to cool the vicinity of the center in the particular direction of the print medium, and to uniformize a temperature in the vicinity of the center and a temperature in a vicinity of ends in the particular direction of the print medium;

wherein the blower outlet is divided into a plurality of partitions along the particular direction, the ink printer further comprising:

a transporter configured to transport the print medium in a direction intersecting the particular direction, wherein the air blowing section is configured so that, of the air blown toward the surface of the portion of the print medium supported by the printing portion supporting region, an amount flowing to an upstream side than the printing portion supporting region along a transport direction of the print medium by the transporter is smaller than an amount flowing to a downstream side than the printing portion supporting region in the transport direction.

* * * * *